US010333221B2

(12) United States Patent
Yu et al.

(10) Patent No.: US 10,333,221 B2
(45) Date of Patent: Jun. 25, 2019

(54) ANTENNA ARRAY INTEGRATED ON THE METAL BACK COVER OF THE 5G MOBILE TERMINAL

(71) Applicant: SPEED WIRELESS TECHNOLOGY INC., San Jose, CA (US)

(72) Inventors: Bin Yu, Suzhou (CN); Kang Yang, Suzhou (CN)

(73) Assignees: SPEEDLINK TECHNOLOGY INC., Cupertino, CA (US); HUIZHOU SPEED WIRELESS TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 15/726,356

(22) Filed: Oct. 5, 2017

(65) Prior Publication Data

US 2018/0309199 A1 Oct. 25, 2018

(30) Foreign Application Priority Data

Apr. 20, 2017 (CN) ..... 2017 1 0260747

(51) Int. Cl.

| | |
|---|---|
| ***H01Q 5/28*** | (2015.01) |
| ***H01Q 5/45*** | (2015.01) |
| ***H01Q 9/36*** | (2006.01) |
| ***H01Q 21/12*** | (2006.01) |
| *H01Q 21/06* | (2006.01) |
| *H01Q 5/357* | (2015.01) |

(52) U.S. Cl.

CPC ..... *H01Q 5/28* (2015.01); *H01Q 5/45* (2015.01); *H01Q 9/36* (2013.01); *H01Q 21/12* (2013.01); *H01Q 5/357* (2015.01); *H01Q 21/061* (2013.01)

(58) Field of Classification Search

CPC ..... H01Q 5/28; H01Q 9/36; H01Q 21/12; H01Q 5/45; H01Q 5/357; H01Q 21/061

See application file for complete search history.

(56) References Cited

U.S. PATENT DOCUMENTS

| | | | | |
|---|---|---|---|---|
| 8,125,394 | B2 * | 2/2012 | Chiang | H01Q 9/30 343/702 |
| 2016/0351996 | A1 * | 12/2016 | Ou | H01Q 1/241 |
| 2017/0201011 | A1 * | 7/2017 | Khripkov | H01Q 1/243 |
| 2018/0062256 | A1 * | 3/2018 | Kim | H01Q 1/243 |

* cited by examiner

*Primary Examiner* — Graham P Smith

(74) *Attorney, Agent, or Firm* — Womble Bond Dickinson (US) LLP

(57) ABSTRACT

An antenna element includes a feed probe, an insulating sleeve, and a reflecting cavity. The reflecting cavity is formed by an inner concave of an outer side of the metal frame of the metal back cover. The reflecting cavity includes a first wall and a second wall. One end of the feed probe is connected with the first wall. The middle of the feed probe is connected with the second wall through an insulating sleeve, and the other end of the feed probe is connected with a signal feeder line. The present invention also provides an RF frontend system which includes the above mentioned antenna system. Through an architecture which includes a feed probe and a reflecting cavity, the present invention realizes that the 5G antenna is arranged at the sides of the mobile terminal. Therefore the 5G antenna can coexist with 3G, 4G, GPS, WIFI and other antennas.

18 Claims, 11 Drawing Sheets

ANTENNA ARRAY INTEGRATED ON THE METAL BACK COVER OF THE 5G MOBILE TERMINAL

RELATED APPLICATIONS

This application claims the priority of Chinese patent application No. 201710260747.4, filed Apr. 20, 2017, which is incorporated by reference in its entirety.

FIELD OF THE DISCLOSURE

This disclosure relates generally to technical field of antennas. More specifically, this disclosure relates to a wide band antenna element with a reflecting cavity and an antenna system.

BACKGROUND

Fifth generation (5G) mobile communication technology faces the human information society after 2020. The predictable features of 5G technology, such as high data rate, low latency, mass devices connection and low power consumption, will play a very important role in the future society, even though the related technologies are not finalized. As the key component of 5G terminal device, 5G terminal antenna will play an active and important role in promoting the development of the new generation mobile communication system and 5G mobile terminals.

Different from the omnidirectional radiation pattern of 4G mobile terminals, 5G mobile terminals need an antenna array that operates at millimeter wave band to realize beam forming function, but the antenna array at mobile terminals is different from the one of the station. In base station, several 5G base station antenna demos have been demonstrated due to the less restrictions on antenna size and the support of the relatively mature phased array technology. But in mobile terminals, the coexistence of the 5G antenna and the existing 2G/3G/4G/GPS/WIFI/BT antennas is quite challenging due to the narrow antenna space and complicated metal environment of the mobile terminals.

SUMMARY

This disclosure relates generally to an antenna and antenna system applied in a metal back cover of 5G mobile terminals, which aims to realize the coexistence of a 5G antenna and existing second generation (2G), third generation (3G), fourth generation (4G), global positioning system (GPS), WiFi, and Bluetooth (BT) antennas.

In order to realize the above purpose, this disclosure provides an antenna system applied in the metal back cover of the 5G mobile terminal, which includes a metal back cover, a signal feeder line, and at least one antenna element. The antenna element is composed of a feed probe, an insulating sleeve, and a reflecting cavity. The reflecting cavity is formed by an inner concave of the outer side of a metal frame of the metal back cover. The reflecting cavity includes a first wall and a second wall. One end of a feed probe is connected with the first wall and a middle of the feed probe is connected with the second wall through an insulating sleeve. The other end of the feed probe is connected with a signal feeder line. The 5G antenna in this disclosure is located at a side of the mobile terminal, which does not occupy the position of the traditional antennas, so it can coexist with the 2G/3G/4G/GPS/WIFI/BT antennas. The reflecting cavity can change a radiation direction of the 5G antenna, so that the electromagnetic radiation that human suffers can be reduced. For example, it is quite necessary to reduce radiation on the front of the 5G mobile terminal when the user is on the phone.

Further, the shape of the reflecting cavity is a cuboid, and the antenna's operating wavelength is $\lambda$, and the length, width, and height of the reflecting cavity are ranging from to $\lambda$, from $1/10\lambda$ to $1/2\lambda$, and from $1/8\lambda$ to $1/2\lambda$, respectively. The 5G antenna with the above reflecting cavity can produce a better directional radiation. Further, the metal back cover comprises a bottom case and a frame, and the first wall can be a part of the metal bottom case a part of the metal frame. When the first wall is a part of the bottom case, the opening of the reflecting cavity is disposed on the frame. When the first wall is a part of the frame, the of the reflecting cavity is disposed on the bottom case.

Further, the reflecting cavity can be filled with low loss materials whose permittivity is larger than 1 and whose dielectric loss is less than 0.02, for example, plastic. The reflecting cavity can be filled with different materials or filled partially, and the filling method can be nano injection molding. The corresponding filling methods and materials can be selected according to a beam scanning range of the antenna. When the reflecting cavity is filled with plastic material, the distance between elements can be reduced therefore the scanning angle can be increased, but the bandwidth of the antenna will be reduced. The coupling between elements will be increased and the radiation efficiency of the antenna will be decreased. If it is necessary, the reflecting cavity can be filled with air.

Further, a feed hole is set in the first wall, and the feed probe is connected with the feed hole. The end of the feed probe connected with the feed hole has a larger diameter. The feed probe has a screw structure. The longitudinal section of the feed probe can be a T shape or a triangular or a trapezoidal. The feed probe can be selected according to the required bandwidth of the antenna element. The feed probe with a T shape longitudinal has a narrow impedance bandwidth. The feed probe of the other forms have a wider impedance bandwidth, but it can increase the length of the antenna element and reduce the scanning range of the beam.

Further, the antenna element is disposed on a long side of the metal back cover. 5G antenna is disposed on the side of the mobile terminal through an antenna element constituted by a feed probe and a reflecting cavity. The antenna element is disposed on the side of the metal back cover. It is advantageous to form an array, thus it can achieve a high a wide beam width and beam scanning angle. Further, the antenna array includes N elements, and N is a positive integer which is larger than 1. The antenna array can achieve a high gain, a wide beam width and beam scanning angle.

Further, the antenna array system applied in the metal back cover includes at least two sub-arrays which are disposed respectively at both long sides of the metal back cover. The antenna array does not occupy the position of the traditional antennas, so it can coexist with 2G/3G/4G/GPS/WIFI/BT antennas, and it has a wide bandwidth and a high gain, and can achieve a wide beam scanning angle and beam width.

Further, this disclosure also provides a mobile terminal system with the above mentioned antenna system applied in metal back cover, which also includes a radio frequency (RF) transceiver, a receiving and processing circuit, a transmitting and processing circuit, a speaker, a microphone, and a main processor. The above the antennas can be applied in the metal back cover of mobile terminals. Through an antenna element structure constituted by a feed probe and a reflecting cavity, this disclosure realizes that the 5G antenna is disposed at the side of the mobile terminal, therefore the 5G antenna can coexist with 2G/3G/4G/GPS/WIFI/BT antennas.

DETAILED DESCRIPTION

Figure 1:
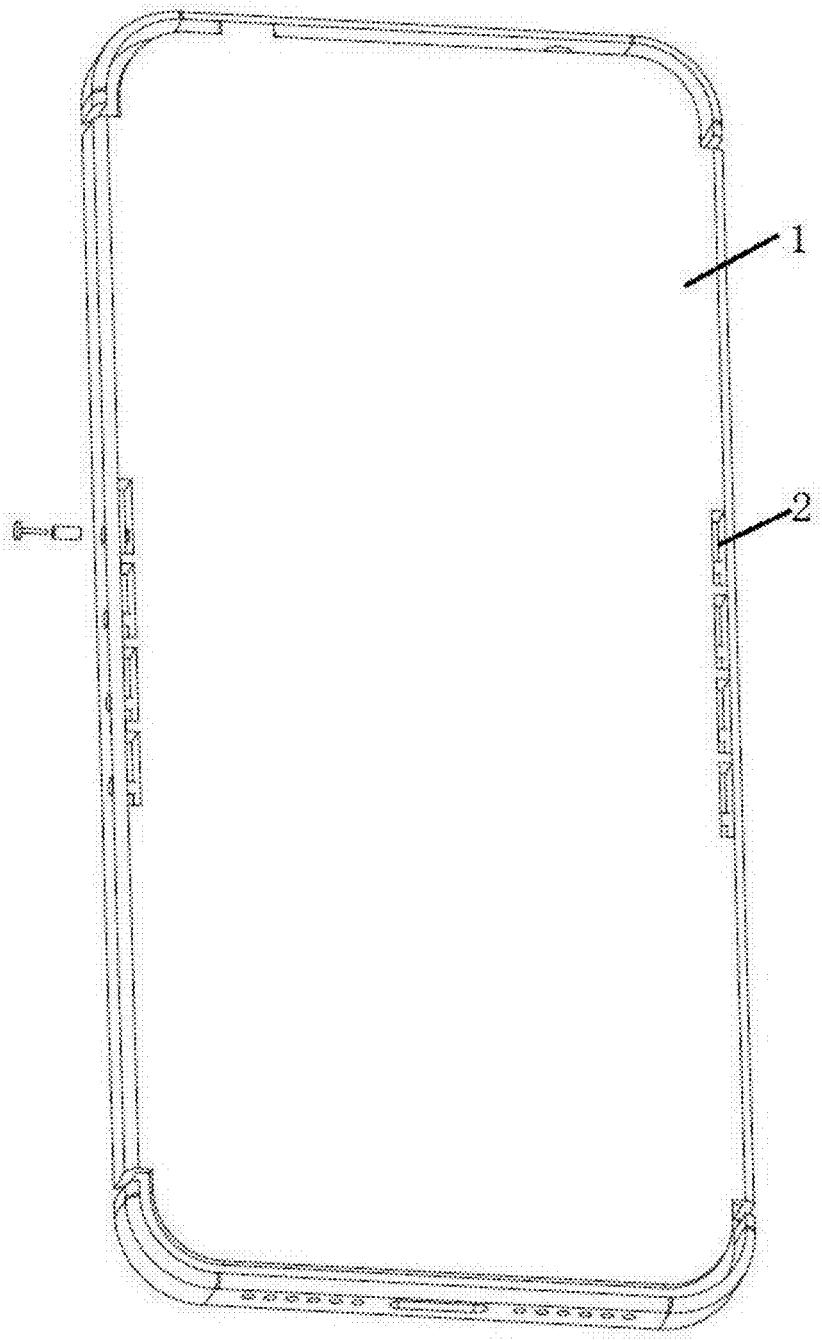
FIG. 1 illustrates an example front view of a 5G mobile terminal with a metal back cover in accordance with this disclosure.
Figure 2:
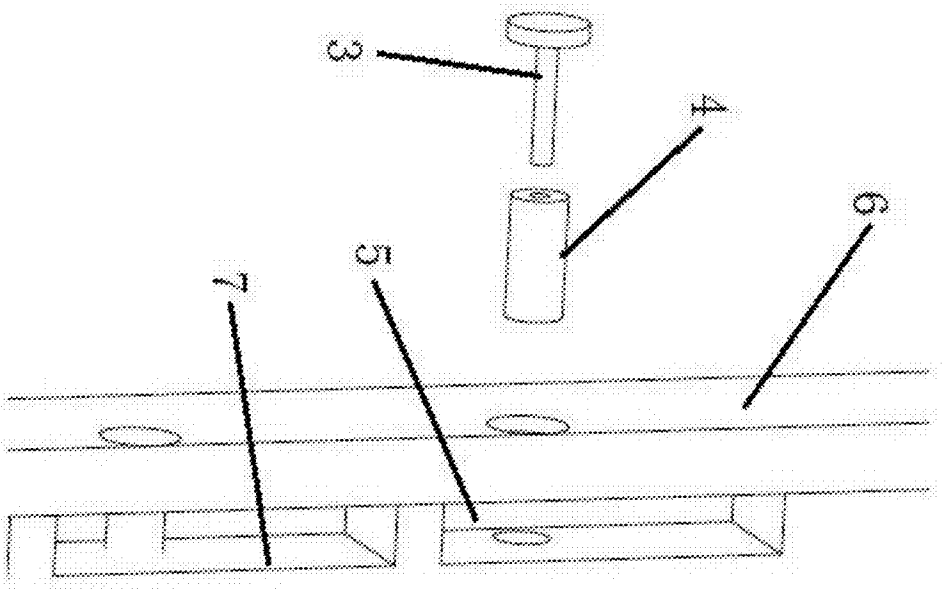
FIG. 2 illustrates an enlarged structure schematic of an antenna element in FIG. 1 in accordance with this disclosure.
Figure 3:
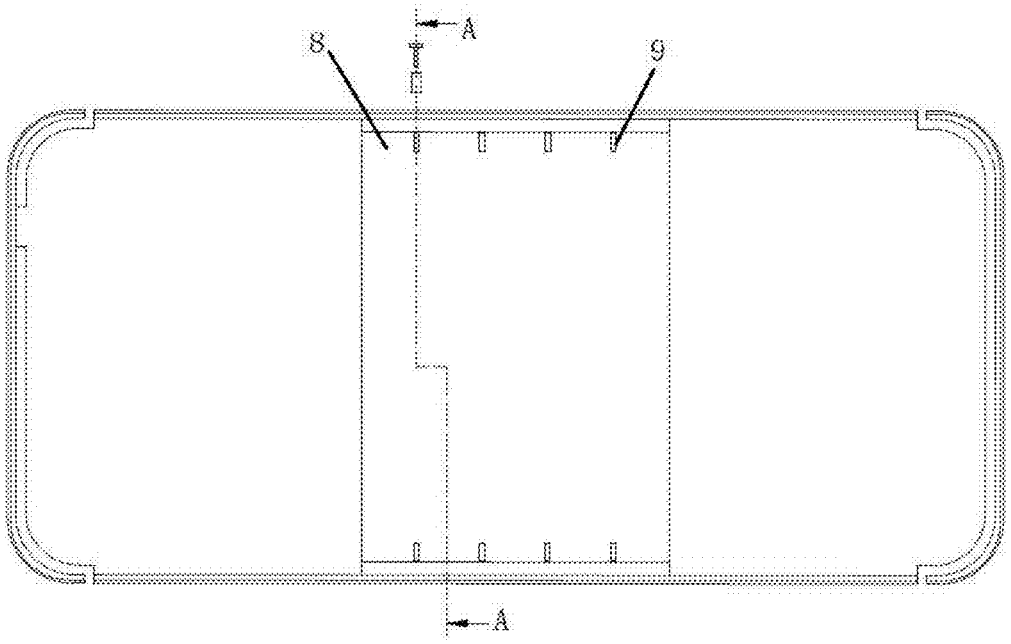
FIG. 3 illustrates an example back view of a 5G mobile terminal with a metal back cover in FIG. 1 in accordance with this disclosure.
Figure 4:
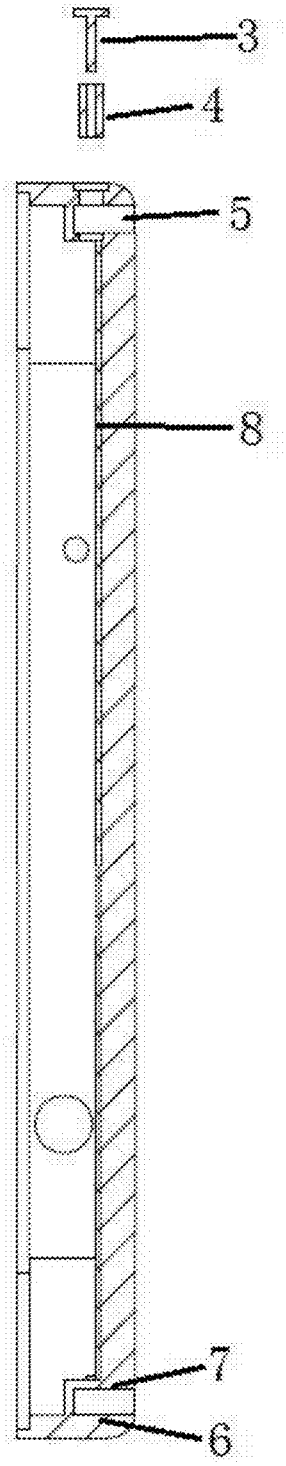
FIG. 4 illustrates an example profile of an antenna element along AA line in FIG. 3 in accordance with this disclosure.

Figures discussed above, and the various embodiments used to describe the principles of the invention in this patent application are by way of illustration only and should not be construed in any way to limit the scope of the invention. Drawings and embodiments are provided so that the invention will be thorough and complete and will fully convey the scope of the invention to those skilled in the art.

Description of appendix mark: 1 denotes a metal back cover, 2 denotes an antenna element, 3 denotes a feed probe, 4 denotes an insulating sleeve, 5 denotes a reflecting cavity, 6 denotes a first wall, 7 denotes a second wall, 8 denotes a main board of a 5G mobile terminal, 9 denotes a signal feeder line, 11 denotes an antenna array, 12 denotes an RF transceiver, 13 denotes receiving and processing circuit, 14 denotes transmitting and processing circuit, 15 denotes a speaker, 16 denotes a microphone, 17 denotes a main processor, 18 denotes an input and output port, 19 denotes a keyboard, 20 denotes a screen, 21 denotes a memory, 100*a*-100*n* denote antenna elements, 110*a*-110*n* denote receiving and transmitting switches, 120*a*-120*n* denote power amplifiers, 130*a*-130*n* denote low noise amplifiers, 140*a*-140*n* denote low loss switches, 150*a*-150*n* denote phase shifters, and 160*a*-160*n* denote RF signals.

Embodiment 1

FIGS. 1 to 4 illustrate an antenna system applied in a metal back cover of a 5G mobile terminal, which includes a metal back cover and at least one antenna element. The antenna element is composed of a feed probe, an insulating sleeve, and a reflecting cavity, reflecting cavity is formed by an inner concave of the outer side of a metal frame of the metal back cover. The reflecting cavity includes a first wall and a second wall. One end of the feed probe is connected with the first wall and the middle of the feed probe is connected with the second wall through the insulating sleeve. The other end of the feed probe is connected with a signal feeder line. The signal feeder line is disposed on a main board of the mobile terminal.

This embodiment realizes the antenna feed process and the RF radiation to a free space through a feed probe connected with the first wall of the reflecting cavity and a feeder line. According to the application requirements, the positions of the reflecting cavity on the mobile terminal, the forms of the feed probe, the filling materials of the reflecting cavity, and the filling methods can be selected.

Embodiment 2

As illustrated in FIGS. 1-4, this embodiment is similar to Embodiment 1. 8 antenna elements are disposed on a metal back cover of a 5G mobile terminal. Each antenna sub-array has 4 antenna elements. Two sub-arrays are disposed at both long sides of the metal back cover respectively. A reflecting cavity is formed by an inner concave of an outer side of a metal frame of the metal back cover through a computer numerical control (CNC) process. The antenna's operating wavelength is $\lambda$ ($\lambda$ is the wavelength of 28 GHz in free space). When the length, width, and height of the reflecting cavity are ranging from $\frac{1}{2}\lambda\sim\lambda$, $\frac{1}{10}\lambda\sim\frac{1}{2}\lambda$, and $\frac{1}{8}\lambda\sim\frac{1}{2}\lambda$, respectively, the antenna element can achieve a better directional radiation. It is simple and convenient to open slots on the metal back cover through the CNC and other processes, and it also does not affect the overall appearance of the metal back cover of the mobile terminal.

Figure 5:
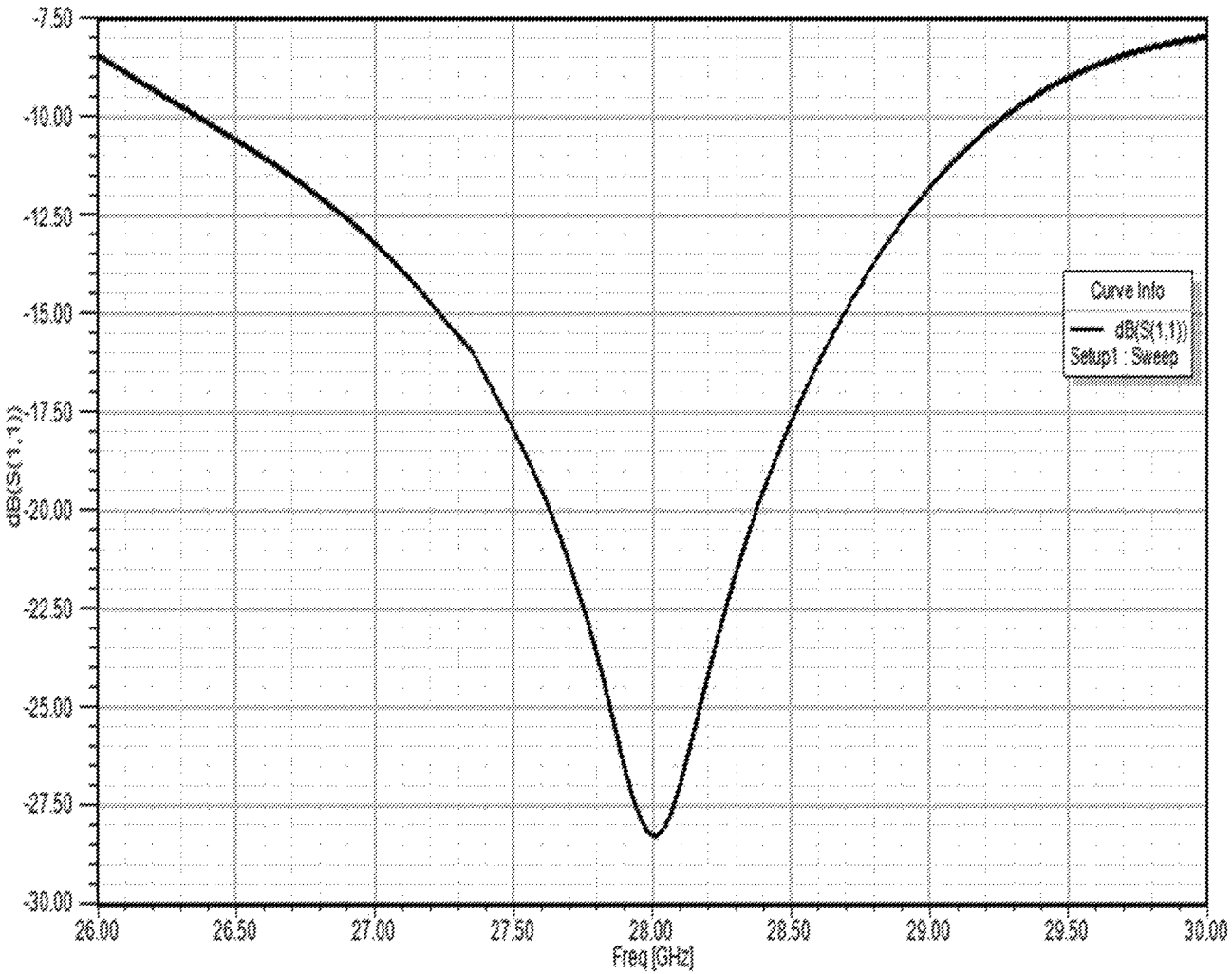
FIG. 5 illustrates an example reflection coefficient curve diagram of an antenna element operating at 26-30 GHz in FIG. 1 in accordance with this disclosure.
Figure 6:
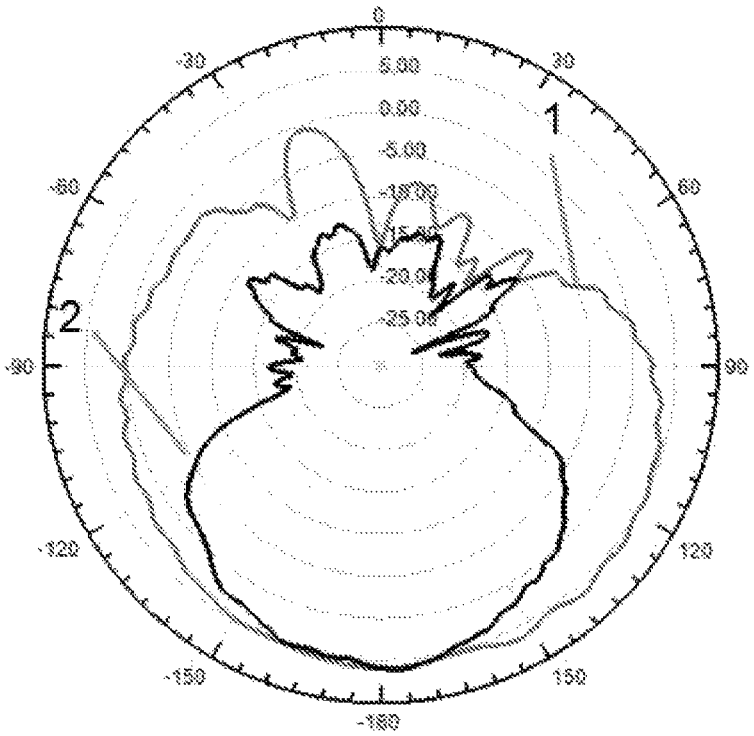
FIG. 6 illustrates an example radiation pattern of an antenna element operating at 28 GHz in FIG. 1 in accordance with this disclosure.

FIG. 5 illustrates a reflection coefficient curve diagram of an antenna element operating at 26-30 GHz. FIG. 6 illustrates a two-dimensional (2D) radiation pattern of the antenna element operating at 28 GHz. Curve 1 denotes a radiation pattern of a vertical section, and curve 2 denotes a radiation pattern of a horizontal section.

Embodiment 3

Figure 7:
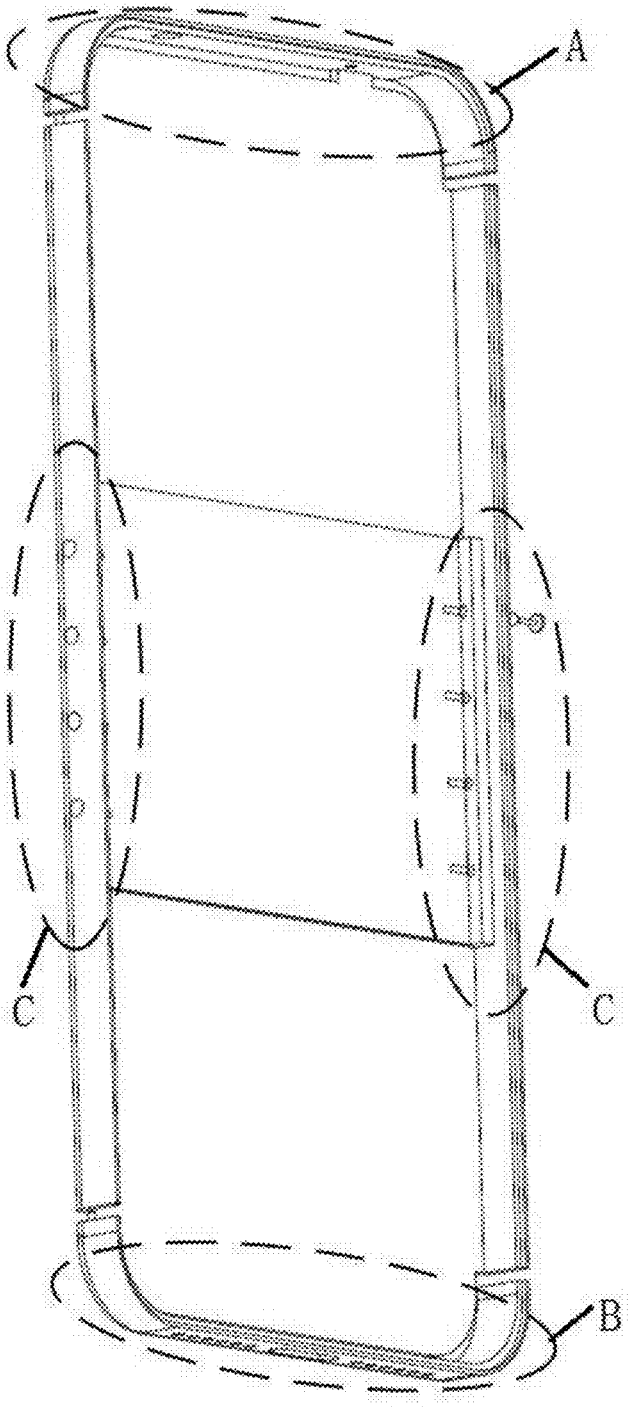
FIG. 7 illustrates an example position schematic of 2G/3G/4G/5G/GPS/WIFI/BT antennas on a metal back cover in accordance with this disclosure.

As illustrated in FIG. 7, a 5G antenna in this embodiment is similar to Embodiment 1 and Embodiment 2. Zone A is the position of a long term evolution (LTE) diversity antenna and GPS/WIFI/BT antennas. Zone B is the position of an LTE main antenna. Zone C is the position of a 5G antenna.

Embodiment 4

This embodiment is similar to Embodiment 1. 16 antenna elements are disposed on a metal back cover of a 5G mobile terminal. Each antenna sub-array has 8 antenna elements. Two sub-arrays are disposed at both long sides of the metal back cover. A reflecting cavity is formed by an inner concave of an outer side of a metal frame of the metal back cover through a CNC process. The antenna's operating wavelength is λ (λ is the wavelength of 28 GHz in free space). When the length, width, and height of the reflecting cavity are ranging from ½λ~λ, 1/10λ~½λ, and ⅛λ~½λ, respectively, the antenna element can achieve a better directional radiation.

Figure 8:
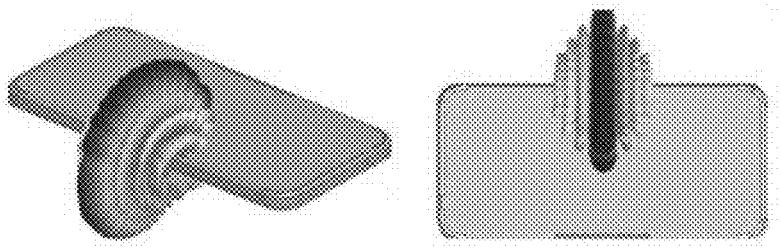
FIG. 8 illustrates an example 3D radiation pattern of an antenna array with 0 degree phase difference between each element in accordance with this disclosure.
Figure 9:
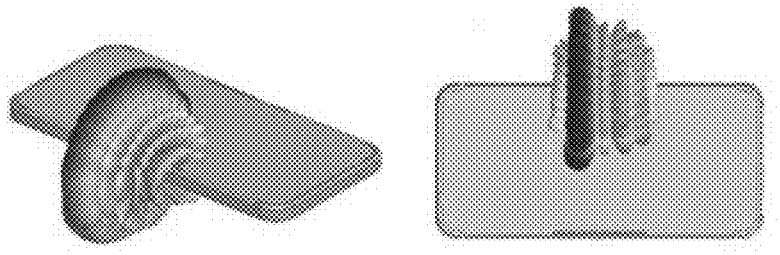
FIG. 9 illustrates an example 3D radiation pattern of an antenna array with 45 degree phase difference between each element in accordance with this disclosure.
Figure 10:
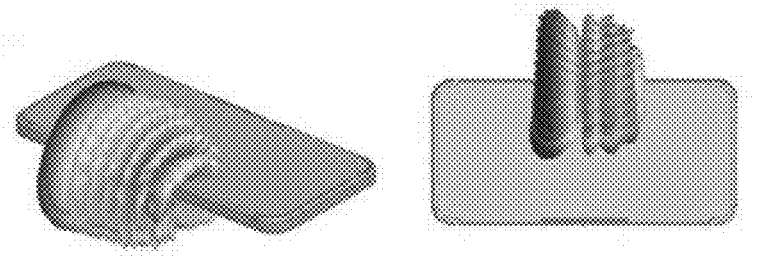
FIG. 10 illustrates an example 3D radiation pattern of an antenna array with 90 degree phase difference between each element in accordance with this disclosure.
Figure 11:
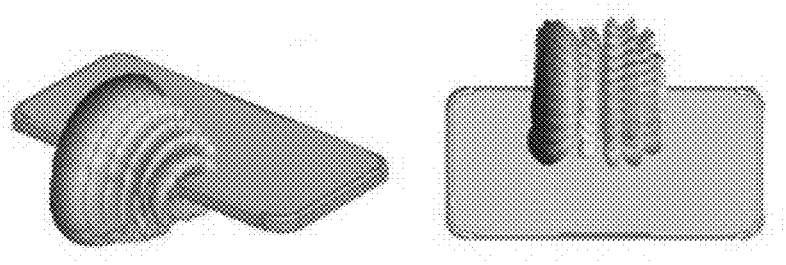
FIG. 11 illustrates an example 3D radiation pattern of an antenna array with 135 degree phase difference between each element in accordance with this disclosure.
Figure 12:
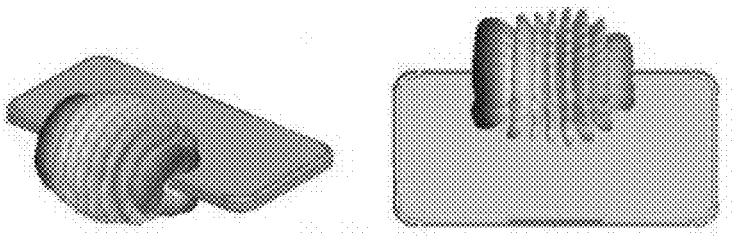
FIG. 12 illustrates an example 3D radiation pattern of an antenna array with 170 degree phase difference between each element in accordance with this disclosure.

FIGS. 8-12 illustrate radiation patterns of an eight-antenna element array. The differences between the adjacent antenna elements are 0 degree, 45 degrees, 90 degrees, 135 degrees, and 170 degrees, respectively. As illustrated in FIG. 8, a radiation direction is 0 when the phase difference between the adjacent antenna elements is 0 degree. As illustrated in FIG. 9, the radiation direction tilts 15 degrees when the phase difference between the adjacent antenna elements is 45 degrees. As illustrated in FIG. 10, the radiation direction tilts 30 when the phase difference between the adjacent antenna elements is 90 degrees. As illustrated in FIG. 11, the radiation direction tilts 45 degrees when the phase difference between the adjacent antenna elements is 135 degrees. As illustrated in FIG. 12, the radiation direction tilts 60 degrees when the phase difference between the adjacent antenna elements is 170 degrees.

Embodiment 4 describes the beam scanning pattern of two 8 antenna elements sub-array that are integrated on the metal back cover of the 5G mobile terminal, and the scanning angle of the antenna sub-array is from −60 degrees to 60 degrees.

Embodiment 5

Figure 13:
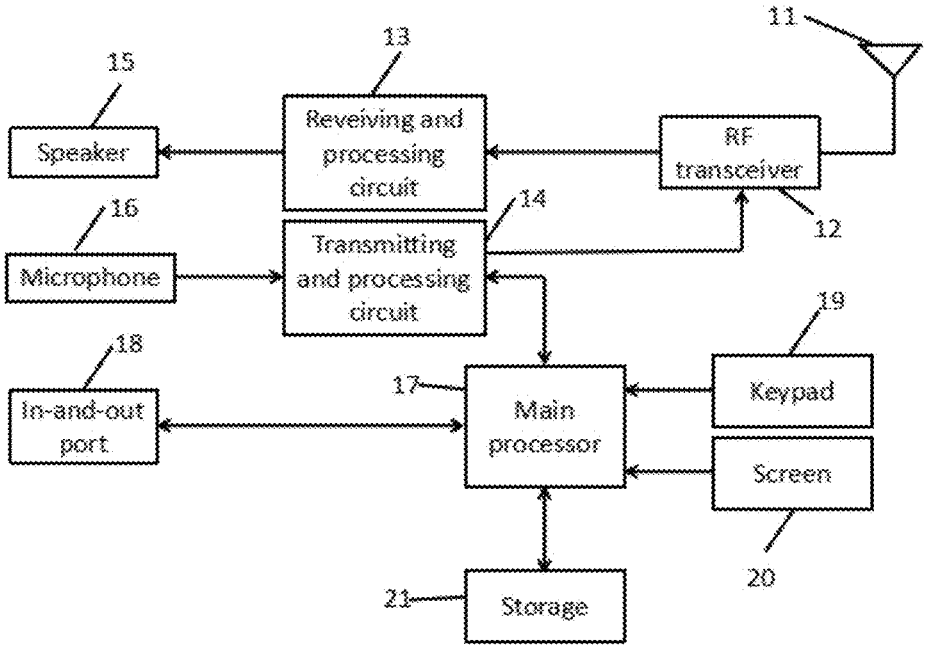
FIG. 13 illustrates an example system structure schematic of a 5G mobile terminal in accordance with this disclosure.

As illustrated in FIG. 13, this disclosure provides a 5G mobile terminal system with the above mentioned antenna systems, which includes an antenna array 11, an RF frontend module 12, a base band receiving & processing circuit 13, a base band transmitting & processing circuit 14, a speaker 15, a microphone 16, a main processor 17, an input and output port 18, a keyboard 19, a screen 20, and a memory 21. The RF frontend module 12 receives an RF signal from the base stations through the antenna array and produces an intermediate frequency (IF) signal and a baseband signal through a down conversion module. The baseband signal is filtered and decoded via receiver (RX) circuit 13, and the above processed signal is transmitted to the speaker 15 or the main processor 17 for further processing. The transmitter (TX) circuit 14 receives a voice signal from microphone 16 and the baseband signal from the main processor 17. After digitally processed in TX circuit 14, the baseband signal will be up-converted to be an RF signal which can be transmitted by the antenna array 11.

Embodiment 6

Figure 14:
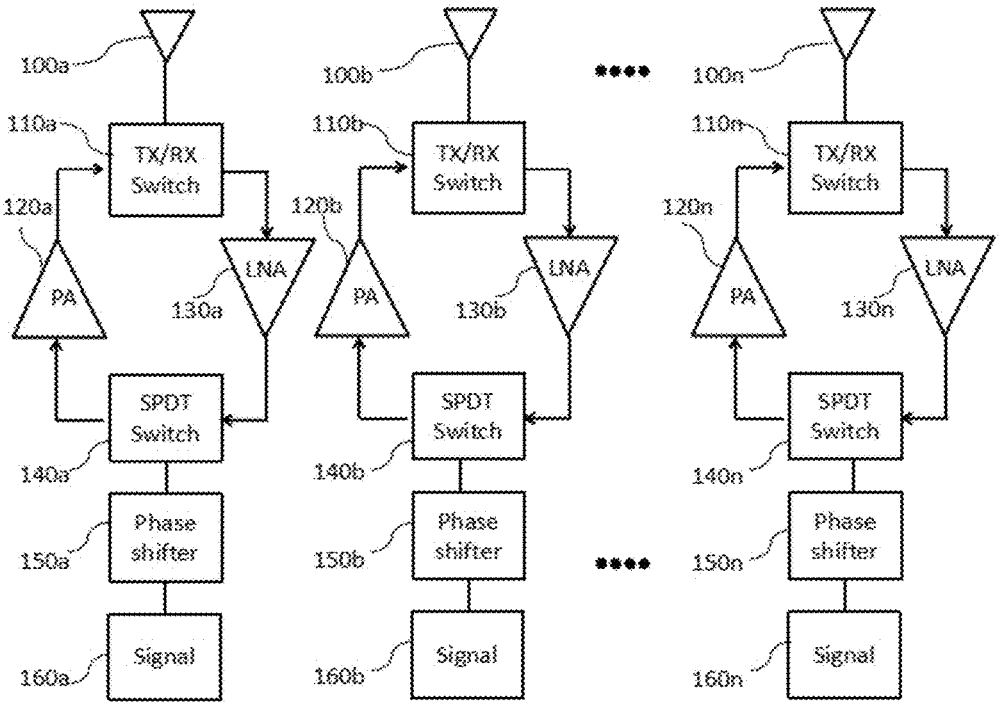
FIG. 14 illustrates an example system structure schematic of an RF frontend system in FIG. 1 in accordance with this disclosure.

As illustrated in FIG. 14, this embodiment is similar to embodiment 5 of this disclosure. The RF frontend transceiver module described in this embodiment can realize the beam scanning function described in Embodiment 4. As shown in FIG. 14, the RF frontend module includes antenna elements 100*a* to 100*n*, T/R switches 110*a* to 110*n*, power amplifiers 120*a* to 120*n* of the transmitter, low noise amplifiers 130*a* to 130*n* of the receiver, low noise switches 140*a* to 140*n*, phase shifters 150*a* to 150*n*, and RF signals 160*a* to 160*n*. The transceiver switches 110*a* to 110*n* and the low loss switches 140*a* to 140*n* can control whether the antenna elements 110*a* to 110*n* in the system receive RF signals or transmit RF signals. When the RF signals are controlled to be transmitted, the RF signals 160*a* to 160*n* have different phase information for each link through the phase shifters 150*a* to 150*n*, and then the RF signals are amplified by the power amplifiers 120*a* to 120*n*, which consists of a pre-power amplifier and a power amplifier, and finally RF signals are transmitted to the antenna elements 100*a* to 100*n*. With different phases of the antenna elements, antenna array can form different beam directions, so that an optimum beam pointing can be achieved in real time.

Obviously, the above embodiments of the present invention are merely for the purpose of clearly stating examples of the invention rather than the limitation of the embodiments of the present invention. As for those skilled in the art in the field, there may be other variations or variations on the basis of the foregoing instructions. There is no need to be exhaustive of all implementations. Any modifications, equivalents, substitutions and improvements made within the spirit and principles of the present invention shall be included in the scope of protection of the claims of the present invention.

What is claimed is:

1. An antenna applied on a metal back cover of a 5G mobile terminal, comprising:

a metal back cover, a signal feeder line; and at least one antenna element, wherein the antenna element is composed of a feed probe, an insulating sleeve, and a reflecting cavity, wherein the reflecting cavity is formed by an inner concave of an outer side of a metal frame of the metal back cover, wherein the reflecting cavity includes a first wall and a second wall, wherein a first end of a feed probe is connected with the first wall, wherein a middle of the feed probe is connected with the second wall through the insulating sleeve, and a second end of the feed probe is connected with the signal feeder line.

2. The antenna applied on a metal back cover of a 5G mobile terminal of claim 1, wherein a shape of the reflecting cavity is a cuboid, and wherein a length, a height, and a width of the reflecting cavity are ranging from ½λ~λ, ⅛λ~½λ, and 1/10λ~½λ, respectively.

3. The antenna applied on the metal back cover of a 5G mobile terminal of claim 1, wherein the metal back cover includes a metal bottom case and a metal frame, and wherein the first wall is a part of the metal bottom case or a part of the metal frame.

4. The antenna applied on the metal back cover of a 5G mobile terminal of claim 1, wherein the reflecting cavity is filled with low loss materials.

5. The antenna applied on the metal back cover of a 5G mobile terminal of claim 1, wherein a feed hole is disposed on the first wall, and wherein the feed probe is connected with the feed hole.

6. The antenna applied on the metal back cover of a 5G mobile terminal of claim 5, wherein one of the first end and the second end of the feed probe connected with the feed hole includes a larger diameter, wherein the feed probe includes a screw structure, and wherein a longitudinal section of the feed probe can be a T shape, a triangular, or a trapezoidal.

7. The antenna applied on the metal back cover of a 5G mobile terminal of claim 1, wherein the antenna element is disposed on a long side of the metal back cover.

8. The antenna applied on the metal back cover of a 5G mobile terminal of claim 1, wherein an antenna array includes N elements, and wherein N is a positive integer which is larger than 1.

9. The antenna applied on the metal back cover of a 5G mobile terminal of claim 8, wherein the antenna array applied in the metal back cover of the mobile terminals includes at least two antenna sub-arrays which are disposed on both sides of the metal back cover respectively.

10. A mobile terminal system, comprising:

a radio frequency (RF) transceiver, a receiving and processing circuit, a transmitting and processing circuit, a speaker, a microphone, and a main processor, which are enclosed by a metal back cover; and an antenna applied on the metal back cover, wherein the antenna includes a signal feeder line, and at least one antenna element, wherein the antenna element is composed of a feed probe, an insulating sleeve, and a reflecting cavity, wherein the reflecting cavity is formed by an inner concave of an outer side of a metal frame of the metal back cover, wherein the reflecting cavity includes a first wall and a second wall, wherein a first end of a feed probe is connected with the first wall, wherein a middle of the feed probe is connected with the second wall through the insulating sleeve, and a second end of the feed probe is connected with the signal feeder line.

11. The mobile terminal system of claim 10, wherein a shape of the reflecting cavity is a cuboid, and wherein a length, a height, and a width of the reflecting cavity are ranging from $\frac{1}{2}\lambda\sim\lambda$, $\frac{1}{8}\lambda\sim\frac{1}{2}\lambda$, and $\frac{1}{10}\lambda\sim\frac{1}{2}\lambda$, respectively.

12. The mobile terminal system of claim 10, wherein the metal back cover includes a metal bottom case and a metal frame, and wherein the first wall is a part of the metal bottom case or a part of the metal frame.

13. The mobile terminal system of claim 10, wherein the reflecting cavity is filled with low loss materials.

14. The mobile terminal system of claim 10, wherein a feed hole is disposed on the first wall, and wherein the feed probe is connected with the feed hole.

15. The mobile terminal system of claim 14, wherein one of the first end and the second end of the feed probe connected with the feed hole includes a larger diameter, wherein the feed probe includes a screw structure, and wherein a longitudinal section of the feed probe can be a T shape, a triangular, or a trapezoidal.

16. The mobile terminal system of claim 10, wherein the antenna element is disposed on a long side of the metal back cover.

17. The mobile terminal system of claim 10, wherein an antenna array includes N elements, and wherein N is a positive integer which is larger than 1.

18. The mobile terminal system of claim 17, wherein the antenna array applied in the metal back cover of the mobile terminals includes at least two antenna sub-arrays which are disposed on both sides of the metal back cover respectively.

* * * * *